US006805572B1

(12) United States Patent
Lai

(10) Patent No.: US 6,805,572 B1
(45) Date of Patent: Oct. 19, 2004

(54) SOCKET STRUCTURE

(76) Inventor: Li-Chun Lai, 21F.-1, No.33, Sec.1, Minsheng Rd., Panciao City, Taipei (TW)

( * ) Notice: Subject to any disclaimer, the term of this patent is extended or adjusted under 35 U.S.C. 154(b) by 0 days.

(21) Appl. No.: 10/634,190

(22) Filed: Aug. 4, 2003

(51) Int. Cl.[7] ..... H01R 4/50
(52) U.S. Cl. ..... 439/348
(58) Field of Search ..... 439/348, 345–347, 439/134, 140, 270

(56) References Cited

U.S. PATENT DOCUMENTS 5,281,162 A * 1/1994 Ursich ..... 439/346
5,893,772 A * 4/1999 Carmo et al. ..... 439/348

* cited by examiner

*Primary Examiner*—Tho D. Ta
*Assistant Examiner*—Felix O. Figueroa
(74) *Attorney, Agent, or Firm*—Alan D. Kamrath; Nikolai & Mersereau, P.A.

(57) ABSTRACT

A socket structure essentially including a socket with a press unit therein, the two sides of the press unit are respectively configured with a first recess and a second recess, and the first recess integrates with a ball, when the ball is placed in the first recess, it protrudes within the power jacks of the socket, when the plug has be plugged in the power jacks of the socket, the ball is made possible to engage with the hole of the electric conduction flake of the plug for fixing the plug without separating from the power jacks of the socket; when the user wants to unplug the plug, he can just press the press unit for making the ball out of the hole of the electric conduction flake of the plug and hide in the second recess, then unplug the plug from the power jacks.

6 Claims, 5 Drawing Sheets

SOCKET STRUCTURE

FIELD OF THE INVENTION

The invention relates to a socket structure, and in particular, to a socket structure capable of fixing the plug in the power jack of the socket thereof.

DESCRIPTION OF THE PRIOR ART

Sockets are comprehensively utilized in daily life, as the interface for conducting alternating current, the user only has to plug the plug of electric product into the power jack of the socket, then actuates the electric product for providing convenience and security to people who use electric product everyday. However, conventional socket is not configured with a fixing structure thereon for fixing the plug, making it possible to unplug the plug from the socket by force, such as pull the electric product, thus the electric product is not work anymore because of a power failure, moreover, due to the pulling force, the copper flakes of the plug are deformed, making it impossible to plug the plug into the power jack of the socket. Therefore, it is necessary to design a socket for firmly fixing the plug.

Accordingly, the above-described prior art product is not a perfect design and has still many disadvantages to be solved The inventor has notice the various disadvantages associated with the conventional sockets and thought to improve it, and after having carried out an intensive study for many years, has successfully developed the improved socket structure of the invention.

SUMMARY OF THE INVENTION

An object of the invention is to provide a socket structure for firmly fixing the plug in the power jack of the socket by engaging the holes of the electric conduction flakes of the plug with balls.

Another object of the invention is to provide a socket structure characterized in that when the user wants to unplug the plug from the socket, he only has to press the press unit of the socket for releasing the plug.

Another object of the invention is to provide a socket structure characterized in the socket structure is covered with a protection sheath for preventing water from permeating into the socket and causing a lightening strike.

The socket structure which is capable of achieving the objects described above includes a socket, a press unit, two balls, an upper cover, a protection sheath and a fixing piece; wherein the top side of the socket is configured with a holding groove, two power jacks are disposed on the front side of the socket, the power jacks interconnects with the holding groove, the interconnection between the power jacks and the holding groove extruding with a fixing pillar, the fixing pillar is a cambered-concave shape for placing the balls, an insertion groove which connects and is perpendicular to the power jacks is disposed on the back of the socket, an electric conduction flake is respectively inserted to the insertion groove; the top of the press unit is a press part, two sides of the press unit are configured with a first recess and a second recess, the first recess and the second recess are connected with each other, the depth of the first recess is smaller than the one of the second recess, and the bottom of the press unit is configured with a compression spring; the press unit is held in the holding groove of the socket for making the ball blocked by the surface of the first recess and protrude within the power jacks; the center of the upper cover is configured with an opening, the bottom of two sides of the opening of the upper cover respectively extruding with a corresponding pillar, the bottom of the pillar is cambered-concave shape; the upper cover engages with and fixes to the top of the socket for making the press part of the press unit protrude throughout the opening of the upper cover, the press unit is covered with the protection sheath, then the protection sheath is fixed by the fixing piece for preventing the fluid from permeating into the socket, the pillar of the upper cover and the fixing pillar in the socket form a hole for preventing the whole ball from entering the power jacks; when the user wants to plug the plug into the power jacks of the socket, he must press the press unit first for hiding the balls in the second recess, then the electric conduction ends of the plug are smoothly inserted into the power jacks on the two sides of the socket, in the meantime, the press unit is able to return to the original position by the elasticity of the bottom of the compression spring for re-holding the balls in the first recess, then the balls are pushed into the power jacks by the first recess and engaged with the holes of the electric conduction ends of the plug for fixing the plug and making it inseparable from the power jacks; when the user wants to unplug the plug, he can also press the press unit for making the balls out of the holes of the electric conduction flakes of the plug and hide in the second recess, thus the electric conduction ends of the plug are released to be unplugged from the power jacks.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
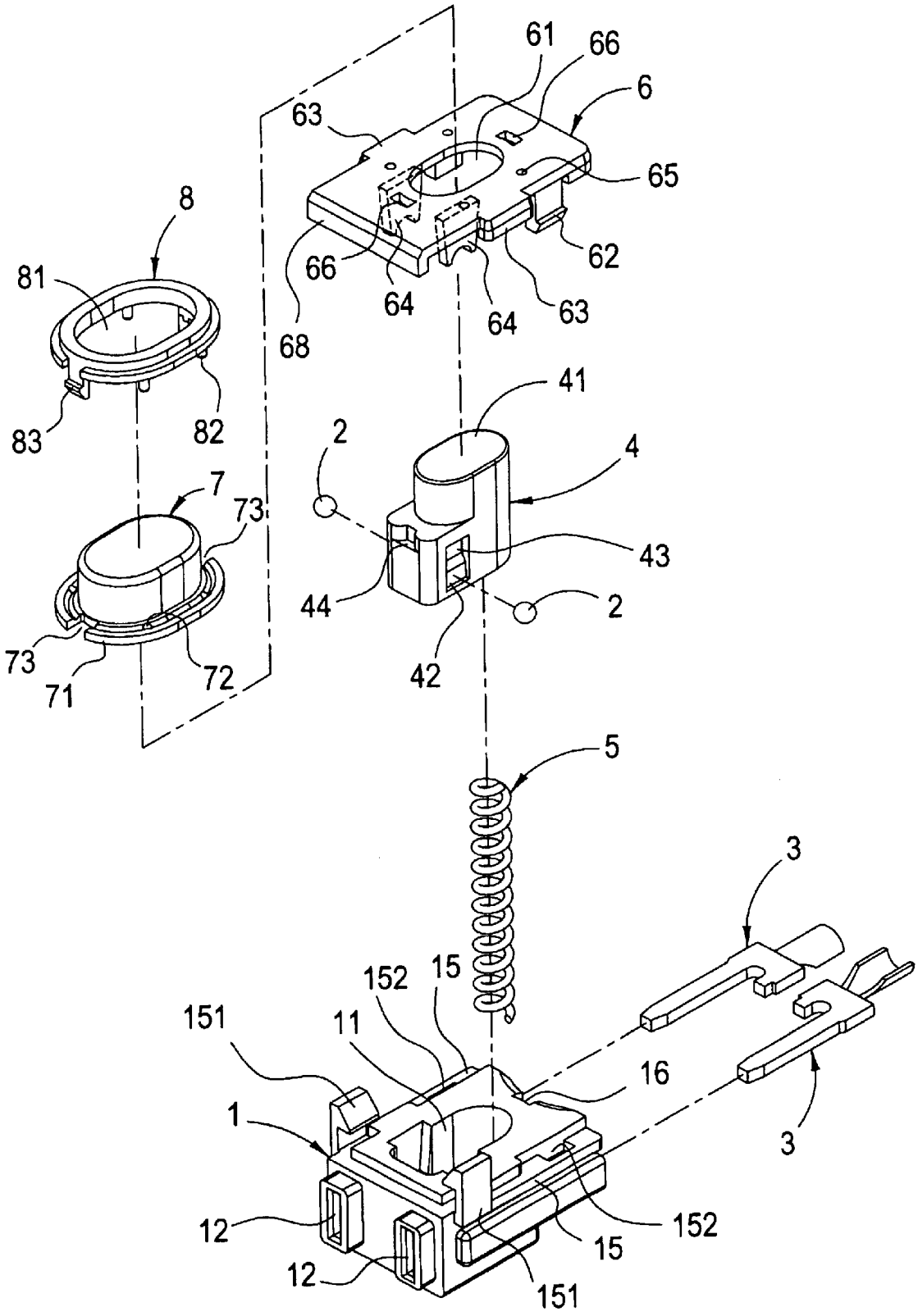
FIG. 1 is an explosion diagram of the improved socket structure according to the invention.
Figure 2A:
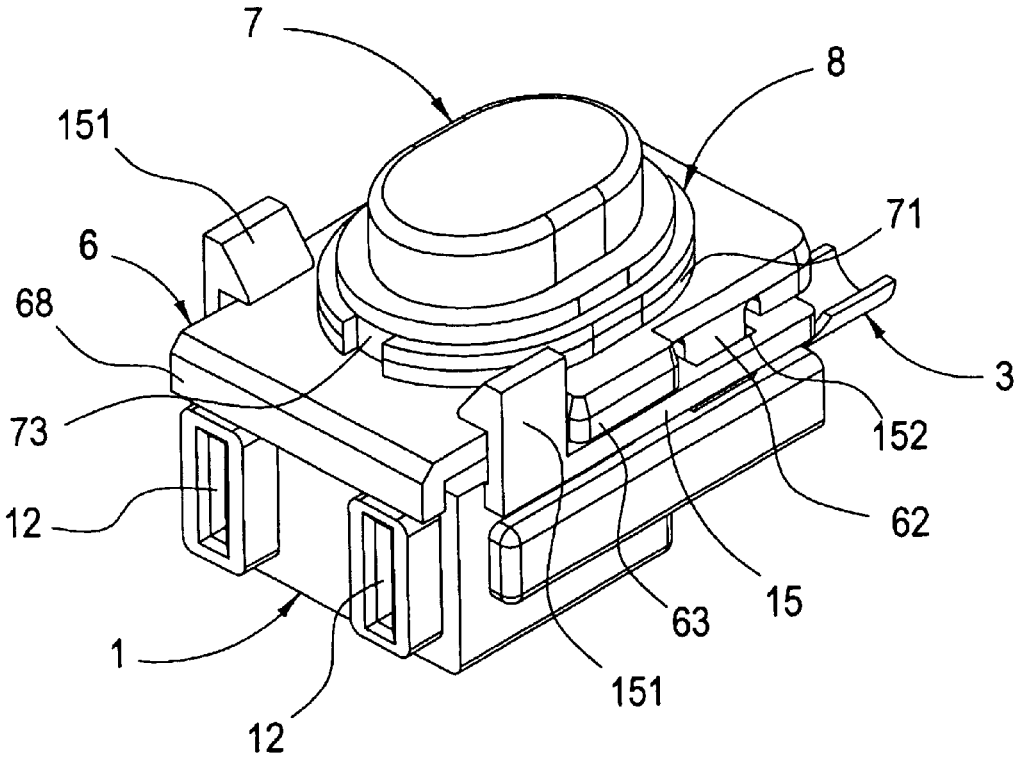
FIGS. 2A, 2B are three-dimensional diagrams of the improved socket structure according to the invention.
Figure 2B:
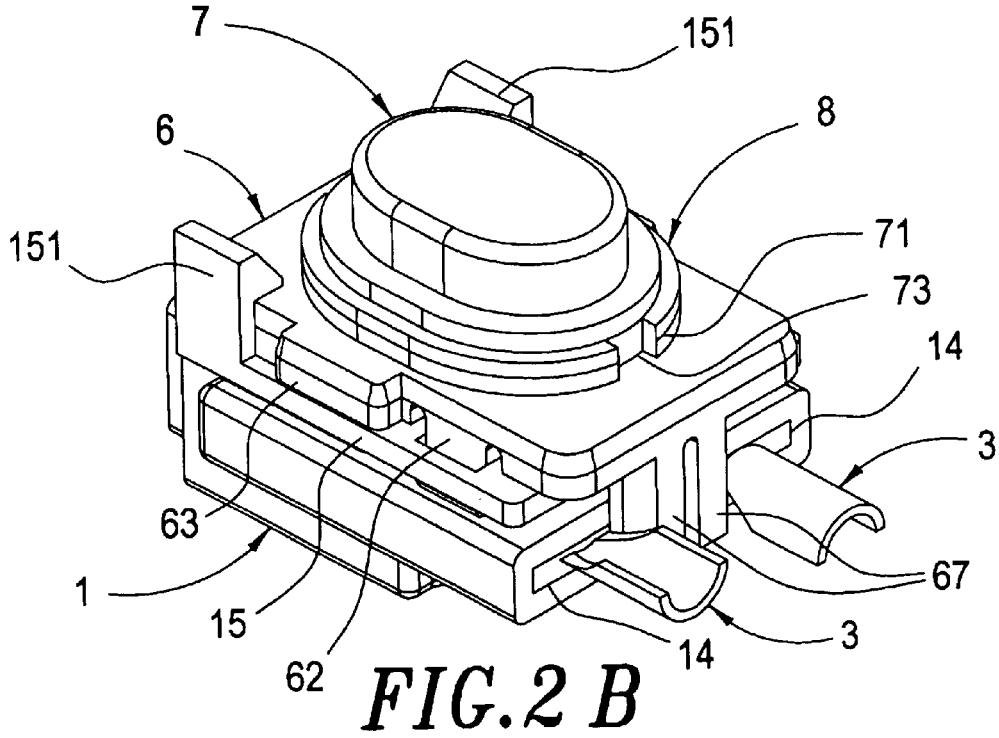
Figure 3A:
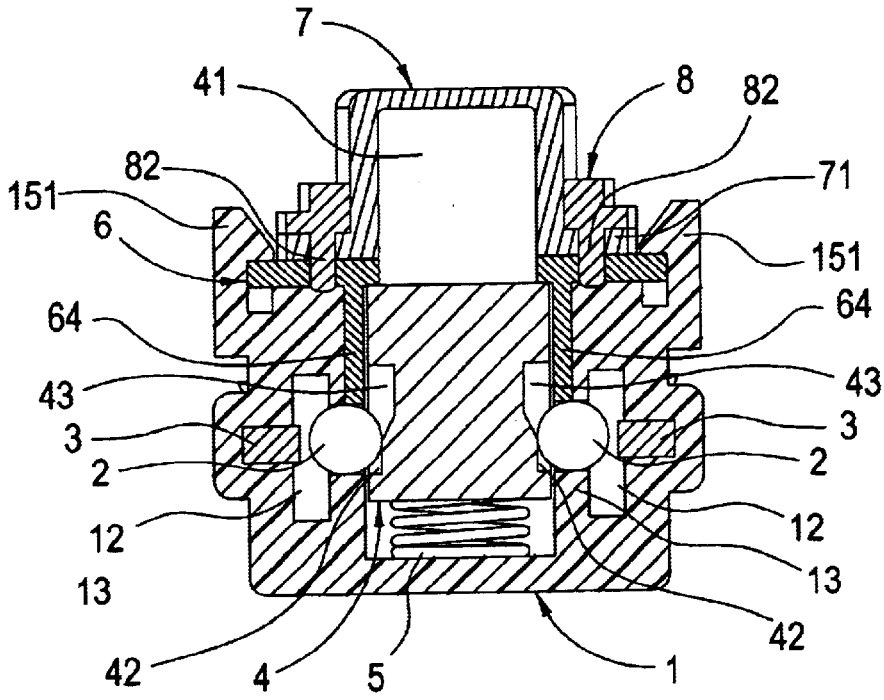
FIGS. 3A, 3B are sectional drawings of the improved socket structure according to the invention.
Figure 3B:
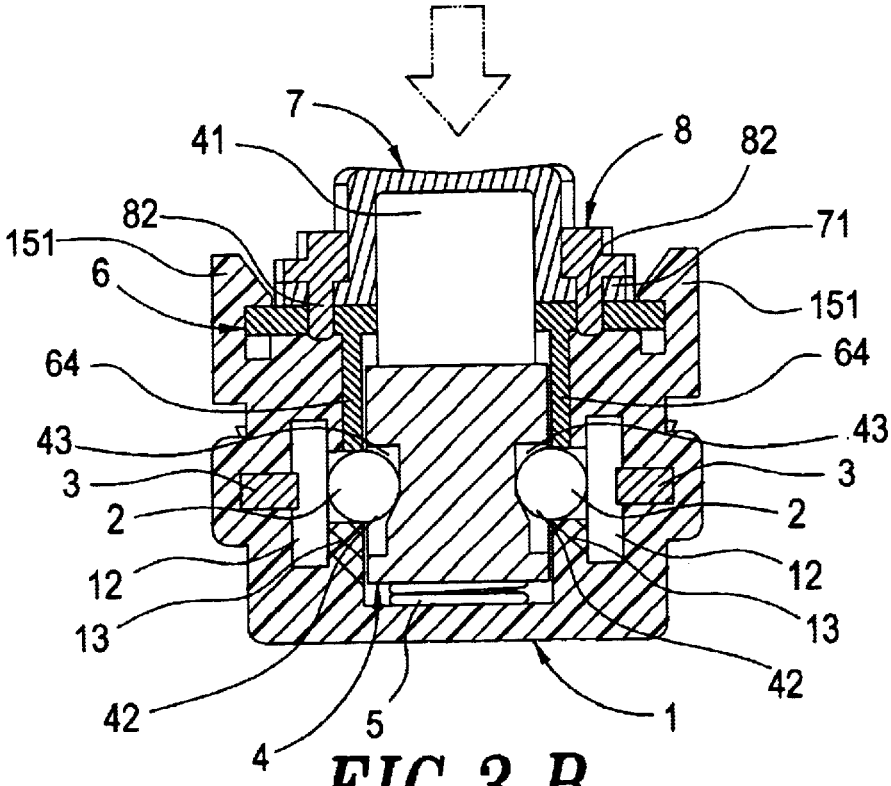
Figure 4A:
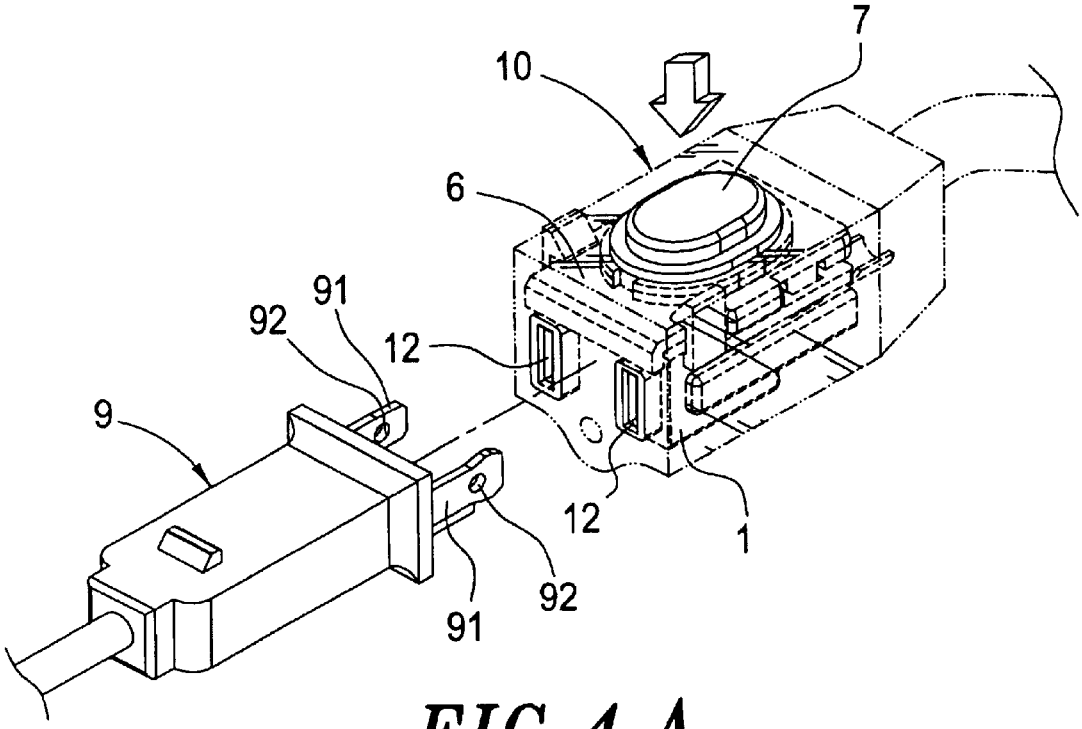
FIGS. 4A, 4B are schematic diagrams of the embodiment of the improved socket structure according to the invention.
Figure 4B:
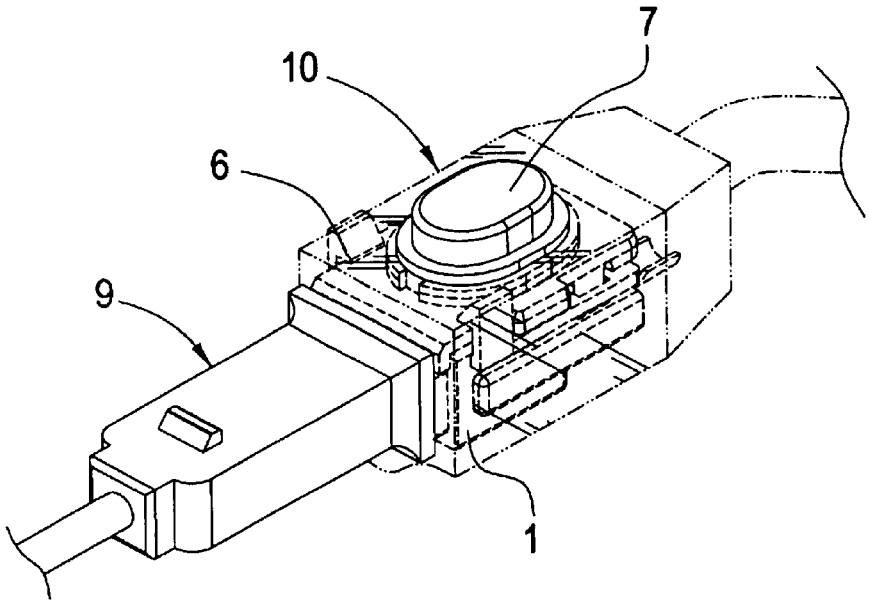
Figure 5A:
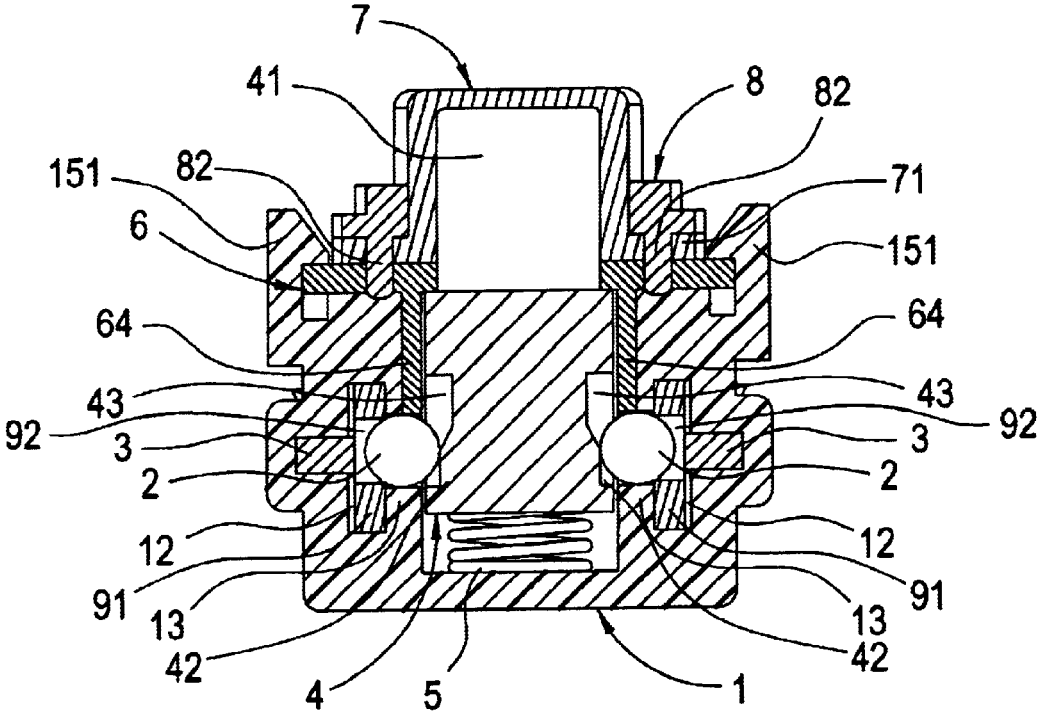
FIGS. 5A, 5B are sectional diagrams of the embodiment of the improved socket structure according to the invention.
Figure 5B:
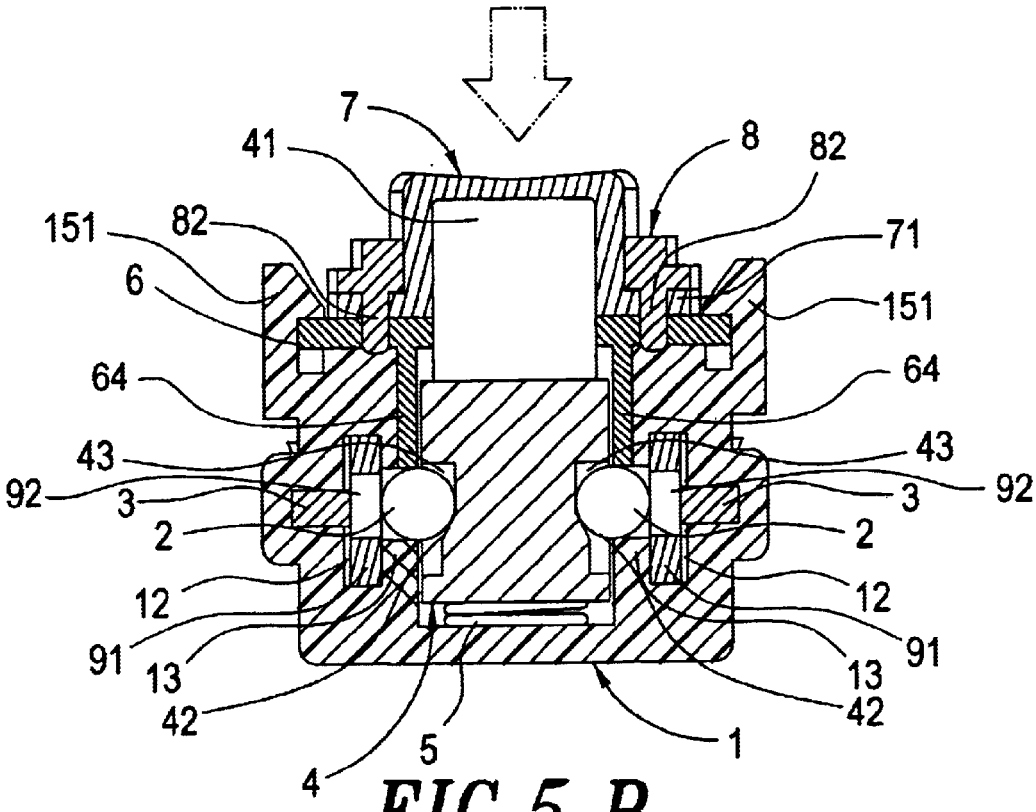

Referring to FIG. 1 to FIG. 3, the schematic diagrams show a socket structure provided by the present invention, the socket structure comprises:

a socket 1, a holding groove 11 is disposed in the center of the socket 1, two power jacks 12 are disposed on the front side of the socket 1, the power jacks 12 interconnect with the holding groove 11, the interconnection between the power jacks 12 and the holding groove 11 extrudes with a fixing pillar 13, the surface of the fixing pillar 13 is a cambered-concave shape, an insertion groove 14 which is connected and perpendicular to the fixing pillar 13 is disposed on the back side of the socket 1, the two sides near the top of the socket 1 respectively extrude with a block board 15, the end of the block board 15 closing to the power jacks 12 comprises an incline 151, and each block board 15 is configured with a buckle hole 152, and the back side of the top surface of the socket 1 is configured with a depression 16;

two balls 2, the balls 2 are respectively integrated with the cambered-concave surface of the fixing pillar 13 for entering the power jacks 12 on the two sides of the socket 1;

two electric conduction flakes 3 are inserted in the insertion groove 14 on the back side of the socket 1 and protrude in the power jacks 12;

a press unit 4, a combination groove (which is not shown in the diagram) is disposed on the bottom of the press unit 4, a press part 41 is disposed on the top of the press unit 4, and the two sides of the press unit 4 are respectively configured with a first recess 42 and a second recess 43, the depths of the first recess 42 and the second recess 43 are different, the depth of the first recess 42 is smaller than the one of the second recess 43, the connection between the first recess 42 and the second recess 43 is an incline, the front edge of the press unit 4 is configured with a depression 44, the press unit 4 is held in the holding groove 11 of the socket 1 for making the first recess 42 of the press unit 4 corresponding to the power jacks 12 of the socket 1;

a compression spring 5, one end of the compression spring 5 is held in the combination groove disposed on the bottom of the press unit 4, the other end touches the bottom of the holding groove 11 of the socket 1, when pressing the press unit 4, the press unit 4 can return to the original position by the elasticity of the compression spring 5;

an upper cover 6, an opening 61 is disposed on the center of the upper cover 6, two edges of the upper cover 6 respectively extrude downward with a buckle pillar 62 and a fixing pillar 63, the two sides close to the bottom of the opening 61 of the upper cover 6 respectively extrude downward with a corresponding pillar 64, the end surface of the pillar 64 is a cambered-concave surface, the top surface of the upper cover 6 is configured at least one fixing hole 65 and a corresponding buckle hole 66, the back side of the upper cover 6 extrudes downward with two fixing boards 67; the buckle pillar 62 of the two sides of the upper cover 6 engages with the buckle hole 152 on the top of the socket 1, and the fixing pillar 63 engages with the incline 151 of the end of the block board 15 for making the upper cover 6 firmly integrated on the top surface of the socket 1, the press part 41 of the press unit 4 protrudes throughout the opening 61 of the upper cover 6 for the user to press the press unit 4 by the press part 41, the cambered-concave surface of the pillar 66 on the bottom of the upper cover 6 and the cambered-concave surface of the fixing pillar 13 in the socket 1 form a hole for preventing the whole ball 2 from entering the power jacks 12, two fixing boards 67 on the back side of the upper cover 6 are fixed on the back side of the socket 1 for blocking and fixing the electric conduction flakes 3;

a protection sheath 7, a protrusion 71 is set around the rim of the bottom of the protection sheath 7, the protrusion 71 is configured with at least a hole 72; the press part 41 of the press unit 4 is covered with the protection sheath 7 for covering the whole press part 41, and the protrusion 71 is against the top surface of the upper cover 6 for making the hole 72 thereon corresponding to the fixing hole 65 on the top surface of the upper cover 6;

a fixing piece 8, a fixing hole 81 is disposed on the center of the fixing piece 8, the rim of the bottom extrudes at least a fixing pillar 82, the two sides of the fixing piece 8 are respectively configured with a buckle pillar 83; the protection sheath 7 is covered with the fixing hole 81 of the fixing piece 8 for making the fixing pillar 82 on the bottom of the fixing piece 82 protrude throughout the hole 72 of the protection sheath 7 and the fixing hole 65 of the upper cover 6, the buckle pillar 83 which are respectively placed in the depression 15 of the socket 1 and the depression 44 of the press unit 4 engages with the buckle hole 66 of the upper cover 6 for firmly fixing the fixing piece 8 and the protection sheath 7.

Thus, the socket structure is composed of above-described components.

Please referring to FIGS. 4A, 4D and FIGS. 5A, 5B, those are schematic diagrams of the embodiment according to the present invention, the socket 1 and the upper cover 6 are covered with a wrap layer 10, only the power jacks 12 and the protection sheath 7 extrude out of the wrap layer 10, the protection sheath 7 prevents the fluid from permeating through the press part 41 of the press unit 4 into the socket 1 then the fluid causes a short circuit lightening strike which is dangerous; when the user wants to plug the plug 9 into the power jacks 12 on the two sides of the socket 1, he must press the press unit 4 by the press part 41 of the press unit 4 to compress the compression spring 5 for generating elasticity, then two balls 2 slide from the first recess 42 to the second recess 43 and hides therein and the electric conduction ends 91 of the plug 9 can be smoothly plugged into the power jacks 12; when the press part 41 of the press unit 4 is released from the user, the press unit 4 will return to the original position by the elastic of the compression spring 5 , thus the balls 2 are guided to be held in the first recess 42 by the incline between the first recess 42 and the second recess 43 and pushed into the power jacks 12 by the first recess 42, the balls 2 engages with the holes 92 of the electric conduction ends 91 of the plug 9 for fixing the electric conduction ends 91 and being inseparable from the power jacks 12; when the user wants to unplug the electric conduction ends 91 of the plug 9, he can also press the press unit 4 for making the two balls 2 out of the holes 92 of the electric conduction ends 91 of the plug 9 and hide in the second recess 43, thus the electric conduction ends 91 of the plug 9 are unplugged from the power jacks 12.

The socket structure provided by the present invention further comprises the following advantages when comparing to the prior art:

1. The present invention is to provide a socket structure for firmly fixing the plug in the power jack of the socket by engaging the holes of the electric conduction flakes of the plug with balls.

2. The present invention is to provide a socket structure characterized in that when the user wants to plug/unplug the plug into/from the socket, he has to press the press unit of the socket for releasing the plug.

3. The present invention is to provide a socket structure characterized in the socket structure is covered with a protection sheath for preventing fluid from permeating into the socket and causing a lightening strike.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A socket structure, comprising:

a socket disposing a holding groove in a center thereof, two power jacks being disposed on a front side of the socket, the power jacks interconnecting with the holding groove, the interconnection between the power jacks and the holding groove extruding with a fixing pillar, two insertion grooves being disposed on a back side of the socket;

two balls respectively combining with a surface of the fixing pillar of the socket for enabling the balls to enter the power jacks of the socket;

two electric conduction flakes respectively being inserted in the insertion groove on the back side of the socket and protruding in the power jacks;

a press unit, a combination groove being disposed on a bottom of the press unit, a press part being disposed on a top of the press unit, and two sides of the press unit each being respectively configured with a first recess and a second recess, the first recess and the second recess being connected with each other, a depth of the first recess being smaller than a depth of the second recess; the press unit being held in the holding groove of the socket for making the first recess of the press unit corresponding to the power jacks of the socket;

a compression spring, one end of the compression spring being held in the combination groove disposed on the bottom of the press unit, another end touching a bottom of the holding groove of the socket, when pressing the press unit, the press unit being able to return to an original position by the elasticity of the compression spring;

an upper cover, an opening being disposed on a center of the upper cover, two sides of the opening of the upper cover respectively extruding downward with a corresponding pillar; the upper cover engaging with and fixing on a top of the socket for making the press part of the press unit protrude throughout the opening of the upper cover, an end surface of the pillar on the bottom of the upper cover and an end surface of the fixing pillar in the socket forming a hole for preventing the ball from completely entering the power jacks.

2. The socket structure according to claim 1, wherein the outer surface of the press part of the press unit is covered with a protection sheath, the protection sheath is covered with a fixing piece, the fixing piece is firmly engaged with the top of the upper cover for fixing the protection sheath so as to prevent fluid from permeating into the socket through the press part of the press unit.

3. The socket structure according to claim 1, wherein the surface of the fixing pillar of the socket and the surface of the pillar on the bottom of the hole of the upper cover are both concave-cambered surfaces, when the two surface are integrated to form a circular hole for preventing the whole ball from entering the power jacks.

4. The socket structure according to claim 1, wherein two sides near the top of the socket respectively extrude with a block board, an end of the block board closing to the power jacks comprises an incline, and each block board is configured with a buckle hole; two sides of the upper cover respectively extrude with a buckle pillar and a fixing pillar, when the upper cover integrates with the top of the socket, the buckle pillar of the two sides engages with the buckle hole of the block board of the socket, and the fixing pillar engages with the incline of the end of the block board for making the upper cover firmly integrated on the top surface of the socket.

5. The socket structure according to claim 1, wherein a joint between the first recess and the second recess forms an incline for guiding the balls.

6. The socket structure according to claim 1, wherein a back side of the upper cover extrudes with two fixing boards fixing on the back side of the socket for blocking the electric conduction flakes.

* * * * *